US005720240A

United States Patent [19]

Dohn et al.

[11] Patent Number: 5,720,240

[45] Date of Patent: Feb. 24, 1998

[54] LIQUID COOLED CYLINDER HEAD

[75] Inventors: Michael Dohn, Sersheim; Erhard Rau, Weilheim, both of Germany

[73] Assignee: Mercedes-Benz AG, Stuttgart, Germany

[21] Appl. No.: 744,010

[22] Filed: Nov. 5, 1996

[30] Foreign Application Priority Data

Nov. 15, 1995 [DE] Germany ..... 195 42 492.1

[51] Int. Cl.[6] ..... F02F 1/10

[52] U.S. Cl. ..... 123/41.82 R

[58] Field of Search ..... 123/41.82 R, 41.74

[56] References Cited

U.S. PATENT DOCUMENTS 5,357,910 10/1994 Wenger et al. ..... 123/41.82 R

FOREIGN PATENT DOCUMENTS 38 19 655 1/1989 Germany .

41 16 943 6/1992 Germany .

*Primary Examiner*—Noah P. Kamen

*Attorney, Agent, or Firm*—Klaus J. Bach

[57] ABSTRACT

A liquid-cooled cylinder head for a multi-cylinder internal combustion engine includes a cooling water space divided into sections through which gas inlet and outlet passages and recesses for receiving spark plugs or fuel injection nozzles extend. A cooling water passage extends transversely to the longitudinal direction of the cylinder head in the bottom area of the cylinder head between the gas inlet and outlet passages and the recesses and leads to the water space. A cooling water supply passage which is in communication with an engine block cooling water jacket for receiving cooling water therefrom and which extends through the bottom area of the cylinder head to the cooling water passage, is integrally cast into the cylinder head along adjacent at least one of the gas outlet passages.

3 Claims, 2 Drawing Sheets

LIQUID COOLED CYLINDER HEAD

BACKGROUND OF THE INVENTION

The invention relates to a liquid cooled cylinder head for a multi-cylinder internal combustion engine having a water space divided into various sections through which gas intake and outlet channels and at least one spark plug receiving recess extend. A cooling water passage extends adjacent the bottom transversely between the gas intake and outlet passages and is in communication with a cooling water jacket of the crankcase by way of a coolant admission passage.

DE 41 16 943 C1 which is assigned to the assignee of the present application discloses a similar cast cylinder head which is liquid cooled and includes a cooling water space through which gas inlet and outlet channels extend. The cylinderhead further includes a chamber for the reception of a fuel injection nozzle. By way of cooling water bores which, by cooling water admission passages, are in communication with the cooling water jacket of the crankcase housing, the cooling water is conducted from the crankcase housing to the water space of the cylinder head. In this arrangement, the cooling water supply passages consist of bores. This requires substantial cutting and drilling for the cylinder head and the cylinder head must be placed in various positions for that purpose. The manufacture of such a cylinder head is therefore time consuming and expensive.

For general technical background information, reference is also made to DE 38 19 655 C1.

It is the object of the present invention to provide a cylinder head which is relatively simple so that its manufacture is simplified and manufacturing expenses are reduced while cooling of the cylinder head is improved.

SUMMARY OF THE INVENTION

A liquid-cooled cylinder head for a multi-cylinder internal combustion engine includes a cooling water space divided into sections through which gas inlet and outlet passages and recesses for receiving spark plugs or fuel injection nozzles extend. A cooling water passage extends transversely to the longitudinal direction of the cylinder head in the bottom area of the cylinder head between the gas inlet and outlet passages and the recesses and leads to the water space. A cooling water supply passage which is in communication with an engine block cooling water jacket for receiving cooling water therefrom and which extends through the bottom area of the cylinder head to the cooling water passage, is integrally cast into the cylinder head along adjacent at least one of the gas outlet passages.

Internal combustion engines with relatively small combustion chambers have also areas of relatively small size, such as the areas between the spark plug recesses and the exhaust passages, which are however subjected to a high thermal load. In order to be able to cool also these thermally highly loaded areas reasonably well in the cylinder head according to the invention, the cooling for those areas is separated from the cooling of the main cooling water space. In the area of the main cooling water space, there is provided a cooling water passage which extends transversely from the exhaust side of the cylinder head and is in communication with the cooling water jacket of the engine block. The cooling water passage opens into a narrow area between the exhaust valve and the spark plug recess, but it could be provided also in another place. Since the cooling for this small area is separated from that for the main cooling water space, good cooling of the relative small area between the gas exhaust passage and the spark plug recess is possible independently of the cooling of the main water space. All the water fed into the water passage must flow therethrough and into the small area between the gas exhaust passage and the spark plug recess. The cooling water space in the cylinder head is represented by two separate water bodies. The main water space is formed by the so-called main water core. Cooling water admission for the separate supply to the small area between the exhaust channel and the spark plug recess is formed by the auxiliary water core. The cooling water passage is subsequently drilled into the cylinder head.

With the arrangement according to the invention, the manufacture of the cylinder head which consists of a cast is facilitated since the cooling water admission passages are cast into the cylinder head so that the drilling step is eliminated. The casting process permits the provision of a cooling water passage of any desirable shape. It does not need to be a straight bore. It permits the utilization of the shape of the area to provide for a "small cooling water space". At the same time, the cooling of the cylinder head is improved since specifically selected areas can be particularly well cooled by providing corresponding passages in the gaskets in such a way that the cooling water is directed specifically to the selected areas.

If the cooling water passage extends along the outside of at least one of the inlet or outlet passages, an additional "small cooling water space" is formed within the cooling water space of the cylinder whereby direct cooling of the respective gas outlet passages or of other components is achieved.

If the water space is formed by two separate water cores the water admission passages can be formed individually such that the water admission flow to any of the passages can be controlled individually. The water flow through the coolant passages may even be separated by dividing the casting core into separate water cores with correspondingly selected water space cross-sections to which water can be supplied selectively for example by particular openings in the cylinder head gasket.

An embodiment of the invention will be described below on the basis of the drawings.

DESCRIPTION OF A PREFERRED EMBODIMENT

Figure 1:
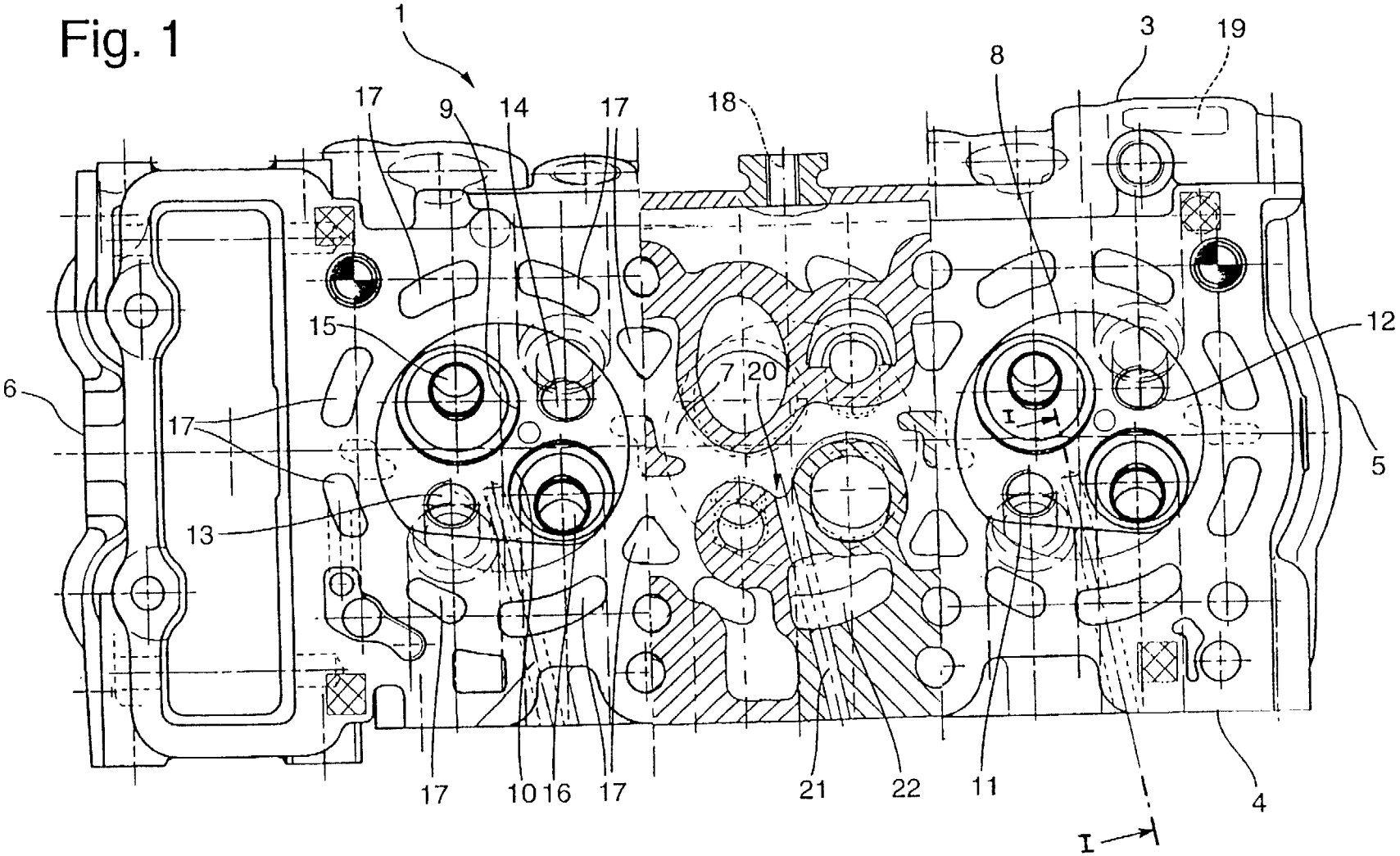
FIG. 1 shows a cylinder head according to the invention as seen from the bottom and in a partial cross-section a cooling water space of the cylinder head.

A cylinder head 1 for a multi-cylinder internal combustion engine which is not shown in detail comprises an integral casting with a cylinder head bottom 2 and longitudinal outer side walls 3 and 4 and front and rear outer end walls 5 and 6. The outer side walls 3 and 4 and front and rear outer end walls 5 and 6 extend from the cylinder head bottom 2 upwardly to a cover separation plane on which a valve cover is disposed which is not shown.

The outer walls 3 to 6 and the cylinder head bottom and the cylinder head top which is not shown enclose therebetween a cooling water space 7.

The cylinder head bottom 2 includes for each cylinder a recessed area which defines a combustion chamber 8. The cylinderhead has, for each cylinder, two passage openings 9, 10 and two more openings 11, 12 extending to the combustion chamber 8. The openings 11, 12 are in communication with recesses 13, 14 for the reception of spark plugs and injectors or similar components. From the passage openings 9, 10, the gas inlet and outlet passages 15, 16 extend to the longitudinal side walls 3, 4 through the cooling water space 7. The passage 15 extending from the passage opening 9 to the outer side wall 3 is the gas inlet passage and the passage 16 extending form the passage opening 10 to the outer side wall 4 is the gas exhaust passage. The recesses 13 and 14 which are arranged with respect to each other in the form of a V extend through the cooling water space 7 toward the cylinder head top. The cylinder head bottom 2 includes cooling water inlet openings 17 which are arranged around the combustion chamber 8 in spaced relationship therefrom. The inlet openings 17 are further in communication with the cooling water jacket of the engine block so that cooling water flows from the engine block water jacket into the cooling water space 7 and transversely through the cooling water space 7. Subsequently, the cooling water flows through a discharge opening 19 on the side of the cylinder-head 15 out of the cylinder head water space 7.

Between the outlet passage 16 and the recess 13, there is a web area 20. Through this web area 20 extends a cooling water passage 21 starting at the side wall 4 of the cylinder head 1 and extending about in the direction of the transverse axis 18. The passage 21 is closed at its outer end by a plug 23, which may be a ball pressed into the passage 21. The passage opens at its inner end from the web area 20 to the cooling water space 7 between the exhaust passage 16 and the recess 13. The cooling water passage 21 is in communication with the cooling water jacket of the engine block by way of a cooling water supply channel 22. The cooling water supply channel 22 extends through the cylinder head bottom 2 so that cooling water flows therethrough from the engine block cooling water jacket and through the cooling water passage 21 to the cooling water space 7. It would of course be possible to provide also another cooling water opening for the cooling water passage 21.

Figure 2:
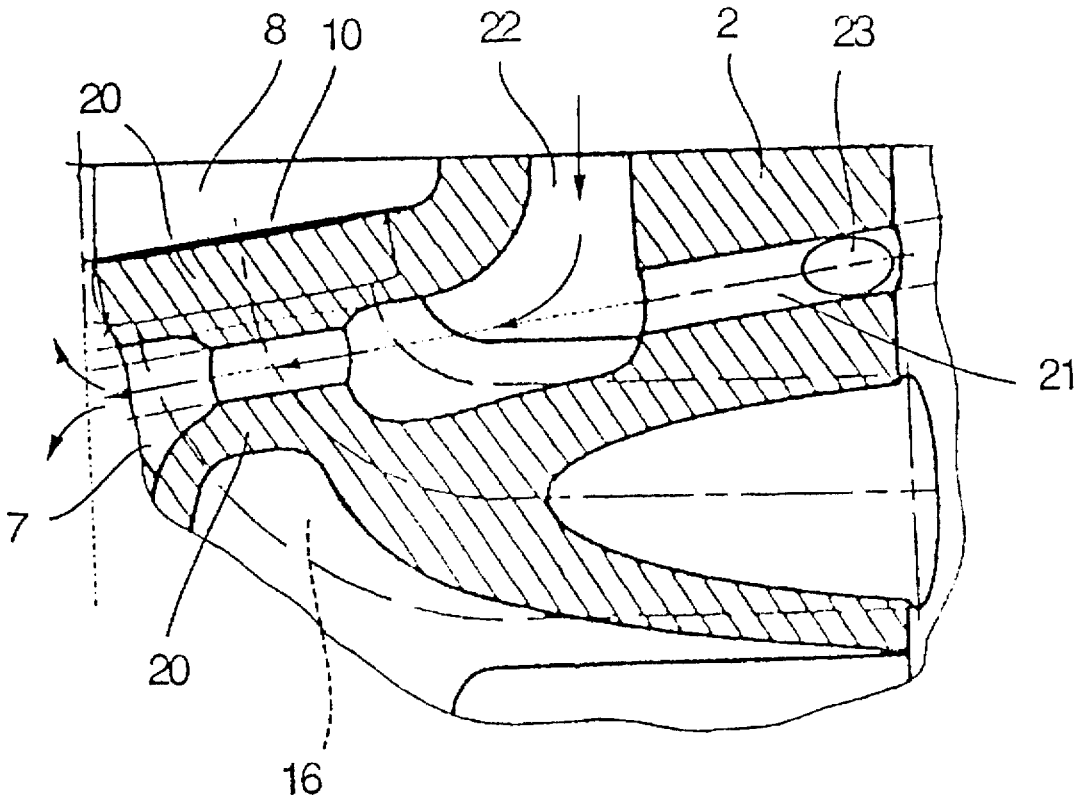
FIG. 2 is a partial cross-sectional view through a cooling water supply passage taken along line I—I of FIG. 1.

In order to provide, in addition to the flow connection between the cooling water passage 21 and the cooling water supply channel 22, for further cooling for the gas outlet passage 16 or for other components, the cooling water supply channel 22 is formed during casting of the cylinder head as a "small cooling water space". Accordingly, the cooling water supply channel does not need to have a circular cross-section. consequently, it can be wrapped at least partially around the gas outlet passage 16 so that the area of the gas outlet passage 16 and the adjacent areas of the cylinder head bottom 2 are cooled by the fresh cooling water over a large surface area. The cooling water supply channel 22 is L-shaped in cross-section. The water entering the cooling water supply channel 22 has to flow through the cooling water passage 21 to exit into the water space 7. The narrow web area 20 between the gas outlet passage 16 and the spark plug recess 13 and also the outer wall of the gas outlet passage 16 are therefore well cooled separately from the cooling of the main water space 7. The cooling water flow into the cooling water supply channel 22 and within the channel is indicated in FIG. 2 by arrows.

The cooling water space within the cylinder head is obtained during casting of the cylinder head by utilizing a main cooling water space core and, separately therefrom, an auxiliary water space core. The main water space core forms the main water space extending between the gas inlet and outlet passages and having water inlet openings separate from those formed by the auxiliary water space core. The auxiliary water space core is in the form of a core strip which is placed into the bottom part of the mold. The cooling water passage 21 is drilled after casting.

It is, consequently, possible to control the water flow through the cooling water passage 21 by providing an appropriate cross-section for the cooling water flow in the cylinder head bottom. In addition, the cooling water supply channel 22 can be formed, by casting, as a "small cooling water space" separate from the main cooling water space. The casting of the cooling water supply channel 22 further permits the cooling water supply channel to have a particularly desirable shape and to control the volume of the partial cooling water flow.

What is claimed is:

1. A liquid-cooled cylinder head for a multi-cylinder internal combustion engine, having a longitudinal axis, said cylinderhead comprising a bottom area for mounting on an engine block having a cooling water jacket and including a cooling water space having cooling water space sections, which are disposed each adjacent a combustion chamber and through which gas inlet and outlet passages and at least one recess for receiving a spark plug or an injection nozzle extend, said cooling water passage having a cooling water supply channel with an inlet opening in said cylinderhead bottom area in communication with the cooling water jacket of said engine block for receiving cooling water therefrom, said cooling water supply channel being cast into said cylinder head and a cooling water passage extending from a side wall of said cylinderhead transversely to the longitudinal axis of said cylinder head in the bottom area of said cylinder head through said cooling water supply channel and through an area between said gas outlet passage and said at least one recess and to said cooling water space for conducting coolant from said water supply channel to said cooling water space, said cooling water passage being plugged at the side wall of said cylinderhead.

2. A liquid-cooled cylinder head according to claim 1, wherein said cooling water supply channel extends at least partially along the outside of said outlet gas passage.

3. A liquid-cooled cylinder head according to claim 1, wherein said cooling water space and said cooling water supply channel are cast integrally with said cylinder head utilizing separate cores for forming said cooling water space and said cooling water supply channel.

* * * * *